US006793564B1

(12) United States Patent
Lupi

(10) Patent No.: US 6,793,564 B1
(45) Date of Patent: Sep. 21, 2004

(54) ROTARY TOOL WITH COMBINED ABRASIVE AND FRAGMENTATION ACTION FOR PRODUCING PROFILES OR CUTS ON SHEETS OF FRAGILE MATERIAL SUCH AS MARBLE, GRANITE, STONE, GLASS AND THE LIKE

(76) Inventor: Quintilio Lupi, 7 Kings Road, London (GB), NW10 2BL ( * ) Notice: Subject to any disclaimer, the term of this patent is extended or adjusted under 35 U.S.C. 154(b) by 0 days.

(21) Appl. No.: 09/857,418

(22) PCT Filed: May 19, 2000

(86) PCT No.: PCT/IT00/00201

§ 371 (c)(1),
(2), (4) Date: Jun. 4, 2001

(87) PCT Pub. No.: WO00/71295

PCT Pub. Date: Nov. 30, 2000

(30) Foreign Application Priority Data

May 21, 1999 (IT) ..... RM99A0322

(51) Int. Cl.[7] ..... B24B 7/00

(52) U.S. Cl. ..... 451/178; 451/542; 451/546; 451/547; 451/449; 451/913

(58) Field of Search ..... 451/8, 9, 10, 11, 451/44, 178, 231, 542, 547, 913, 358, 449, 546

(56) References Cited

U.S. PATENT DOCUMENTS 2,144,987 A * 1/1939 Miller
2,293,103 A * 8/1942 Blomeen
3,612,611 A 10/1971 Ellis

FOREIGN PATENT DOCUMENTS

| | | |
|---|---|---|
| EP | 0 881 048 | 12/1998 |
| EP | 0 919 335 | 6/1999 |
| EP | 0 940 237 | 9/1999 |
| FR | 2 643 583 | 8/1990 |
| IT | RM97A000737 | 11/1997 |
| LU | 79 806 | 1/1980 |

OTHER PUBLICATIONS

Database WPI Section PQ, Week 198629, Derwent Publications Ltd., London, GB; Class P64, AN 1986–188992 & SU 1 196 279 (as UKR Hard Materials), Dec. 1985.
Database WPI Section PQ, Week 197949, Derwent Publications Ltd., London, GB; Class P54 AN 1979–13560b & SU 651 902 (Natapov L M), Mar. 1979.

* cited by examiner

*Primary Examiner*—Eileen P Morgan
(74) *Attorney, Agent, or Firm*—Nixon & Vanderhye

(57) ABSTRACT

The rotary tool for producing profiles or cuts in hard fragile materials such as marble, granite, stone, glass and the like comprises at least one rotationally symmetrical body (1, 2) involving a configuration defined by the envelope of a multiplicity of circular parts (6–13) externally provided with diamond means. The circular parts are separated by grooves (20 to 25) and the configuration corresponds as a negative of profiles or cuts to be produced in the above-mentioned hard fragile materials, the arrangement being such that the production of profiles or cuts is effected jointly by abrasion on the part of the diamond means and by fragile-fracture breaking on the part of the grooves, and possible breaker inserts (30) with a metal pin which is hard or covered with industrial diamond.

12 Claims, 15 Drawing Sheets

Figure 2:
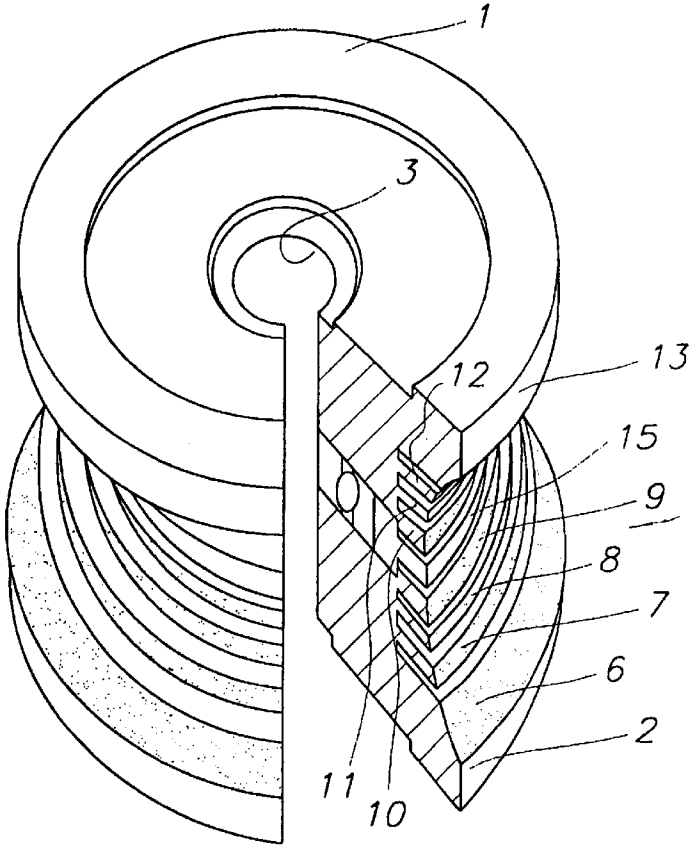

ROTARY TOOL WITH COMBINED ABRASIVE AND FRAGMENTATION ACTION FOR PRODUCING PROFILES OR CUTS ON SHEETS OF FRAGILE MATERIAL SUCH AS MARBLE, GRANITE, STONE, GLASS AND THE LIKE

The present invention concerns tools with a combined abrasive and fragmentation action for the production of profiles or cuts in sheets of fragile material such as marble, granite, stone, glass and the like.

The production of contour edges on sheets or plates of relatively fragile material such as marble, stone, granite, glass or the like, that is to say an operation involving pre-cutting to measure with a contour which is straight or curved in various ways, involves producing the edge in such a way as to afford a configuration in varying shapes The shape may for example be a semicircumference, or a quarter of a circumference or another profile, with curves and possibly with portions of an undercut configuration. Such production procedure requires the removal of material in substantial amounts.

That kind of production procedure was hitherto effected by using rotary diamond tools of a profile corresponding in reverse relationship to that which was to be copied on the edge of the sheet of material being produced. In the prior art those tools are made of metal to which diamonds are applied using known procedures, and the tools were rotated at high speed against the edge of the sheet being produced, in order to remove the excess material by an abrasive action until the contour of the desired shape was achieved.

In practice all the excess material was removed by abrasion, leaving at the end a contour which was shaped in accordance with the configuration of the tool. Subsequently, a finishing and polishing operation is effected by means of other diamond-bearing tools of the same configuration.

The known operating procedure involved in the removal of material along the edge of a sheet of marble or the like suffers from the disadvantage that all the excess material has to be removed by abrasion using the diamond-bearing tool, involving a considerable amount of time and entailing excessive wear of the tool which, once consumed, has to be scrapped since, unlike the milling cutters used for machining metals, they cannot be subjected to a re-sharpening procedure.

A tool of that kind is illustrated for example in EP-B-0 478 518 which has a sensor element which rolls against the surface of the edge of the sheet of material being machined so as to maintain a constant cutting drive into the edge of the sheet of material to follow its contour both in a straight line and in a curve.

It is the object of the present invention to provide a tool, for processing fragile materials of the above-indicated type, combining an abrasive action produced by the diamond means with a mechanical action involving breaking the material which is not removed by the diamond-bearing part, taking advantage of the fragility properties of the material being processed, and thereby permitting a higher processing speed with the same amount of material being removed and a lower tool cost by virtue of the smaller amount of diamond used in the construction of the tool.

Accordingly the tool of the present invention is defined by claim 1.

Figure 1:
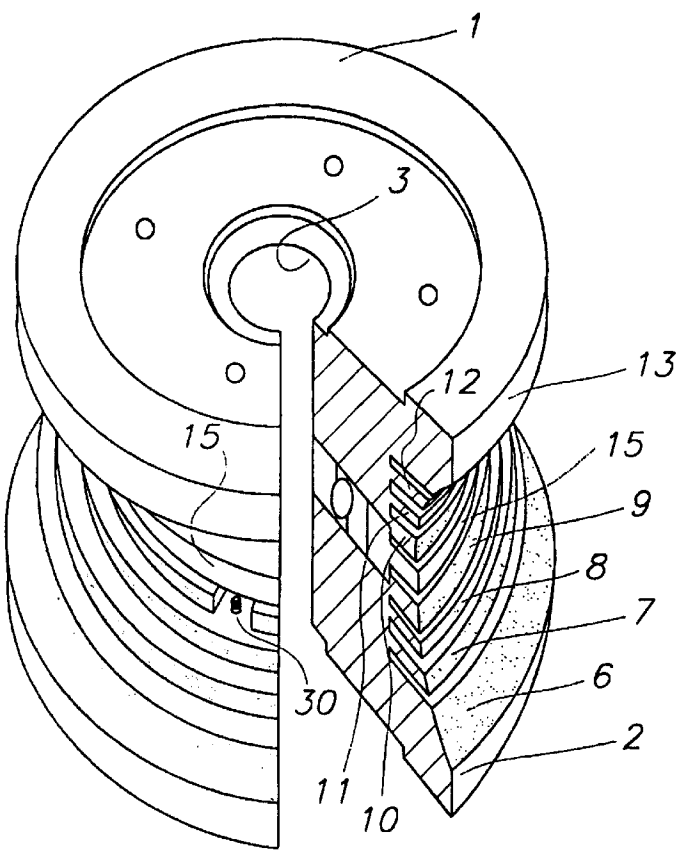
Figure 3:
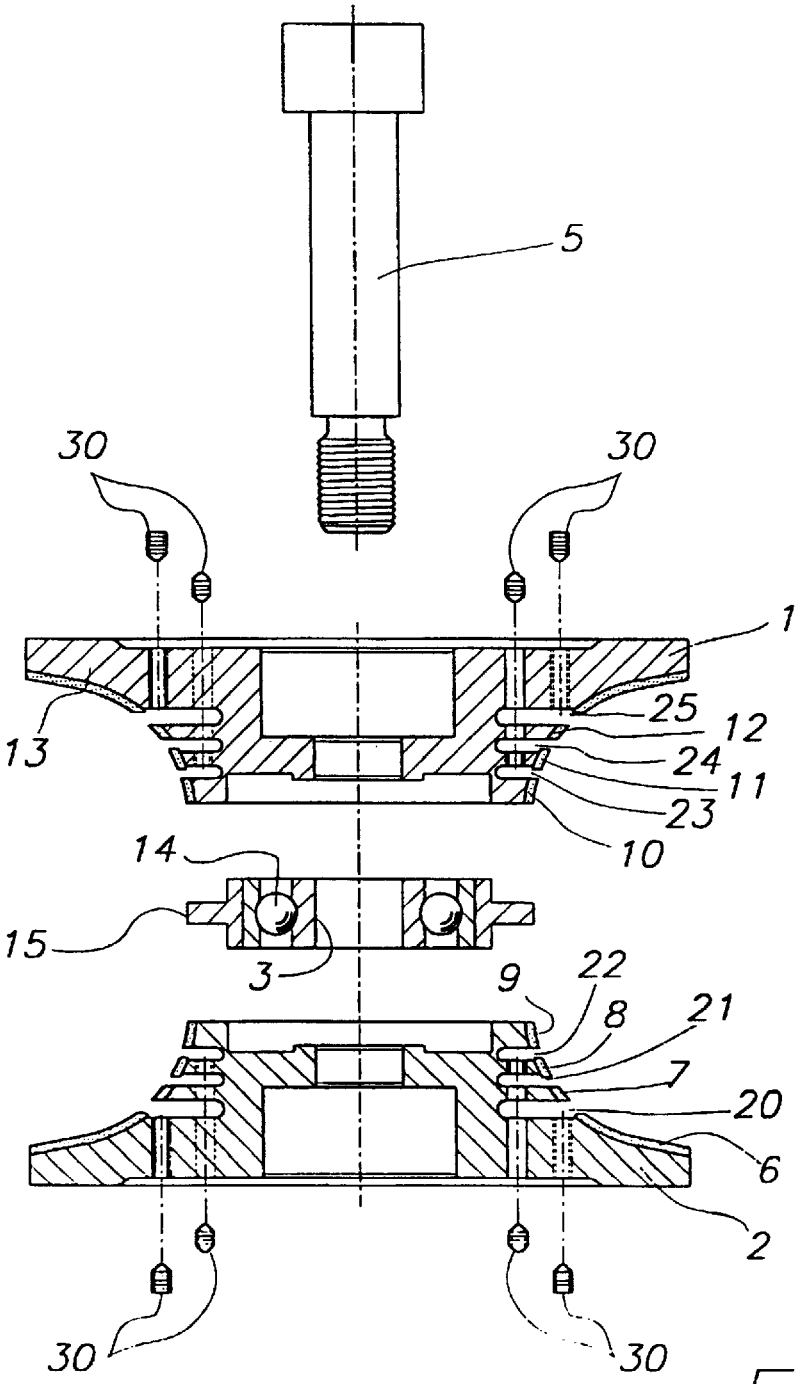
Figure 4A:
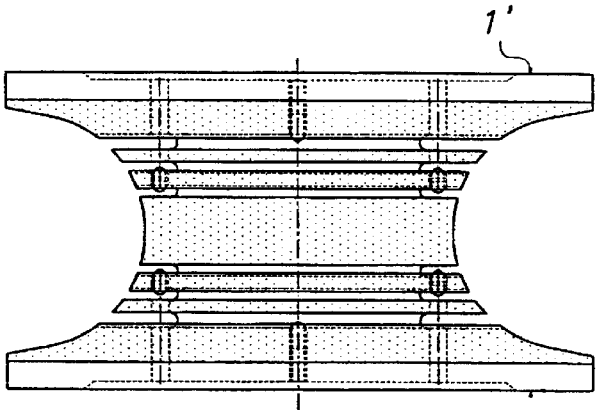
Figure 4C:
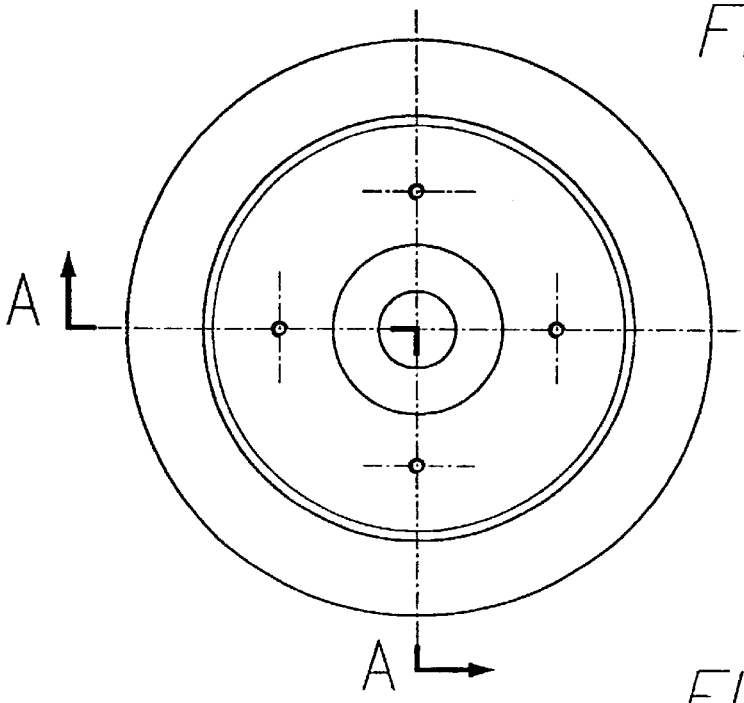
Figure 4B:
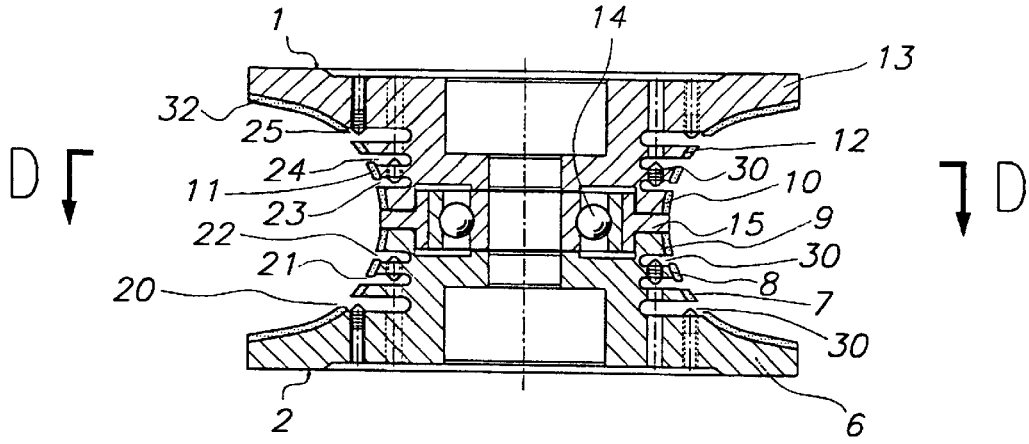
Figure 4D:
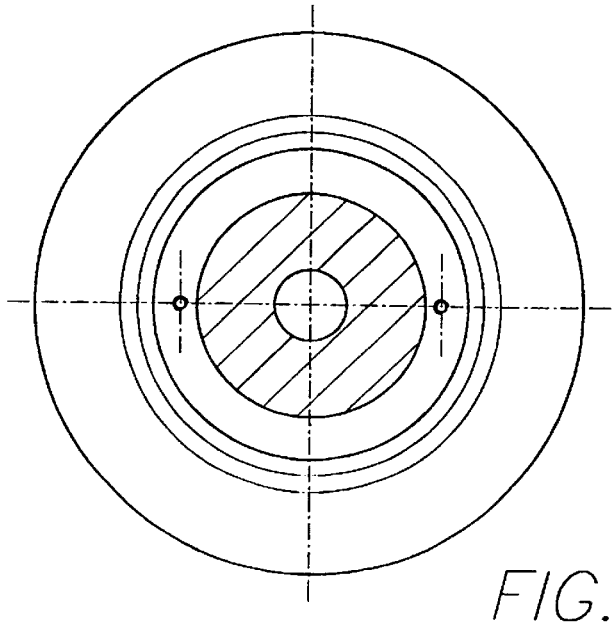
Figure 5A:
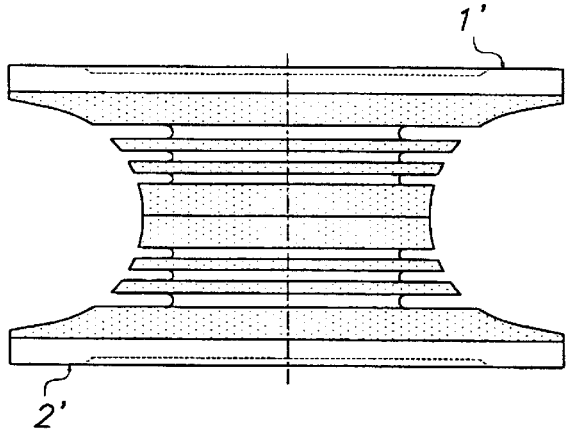
Figure 5C:
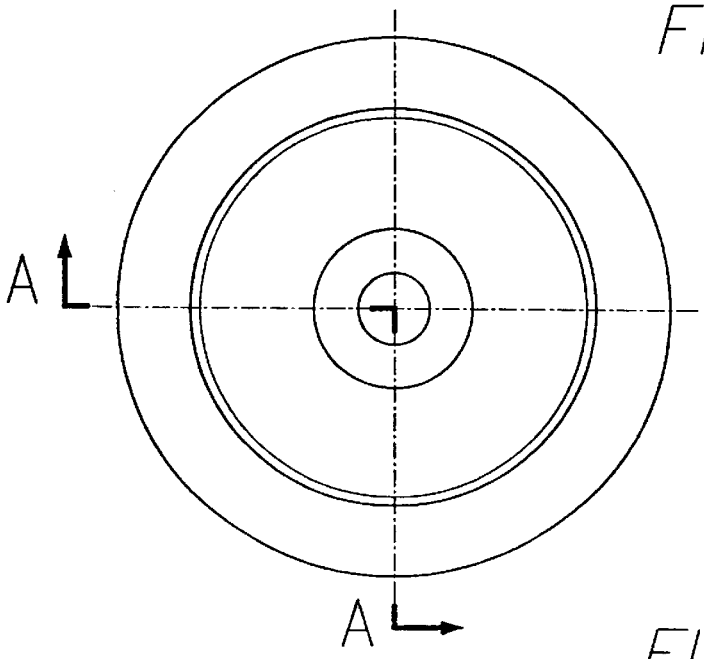
Figure 9A:
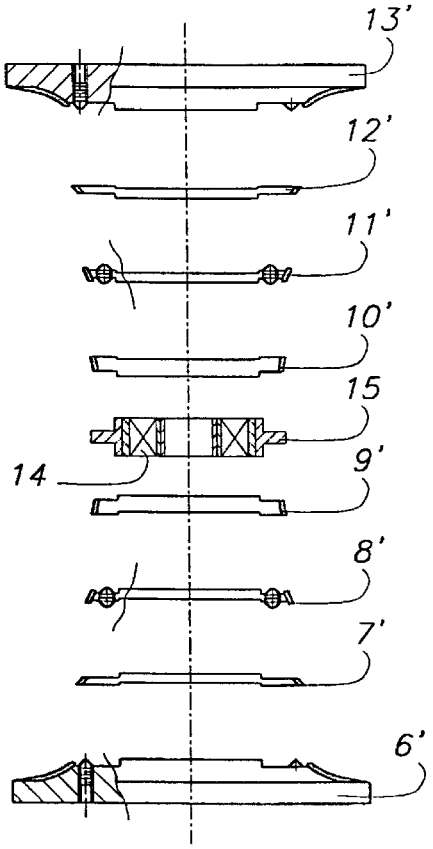
Figure 9B:
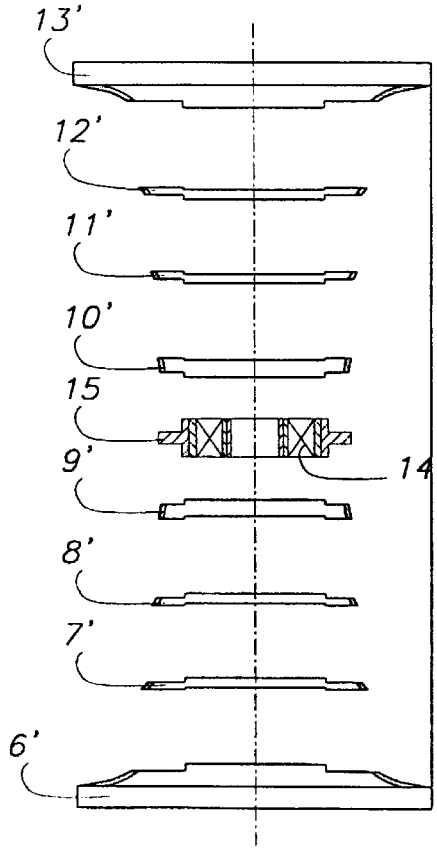
Figure 10A:
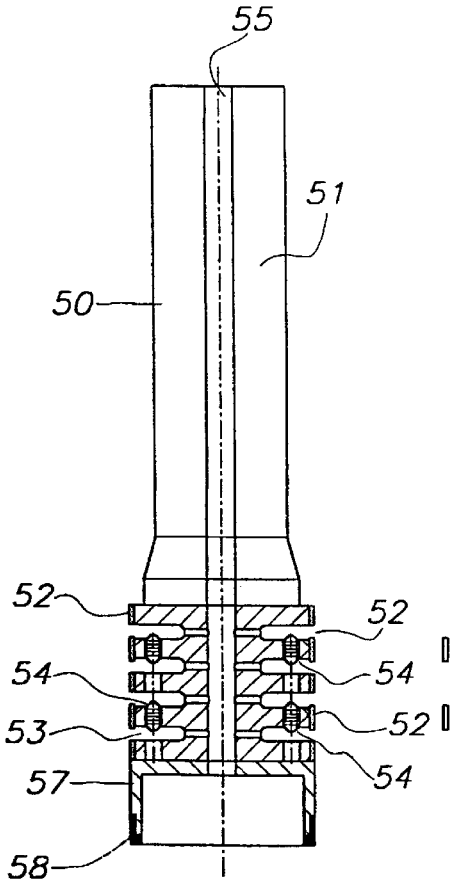
Figure 10B:
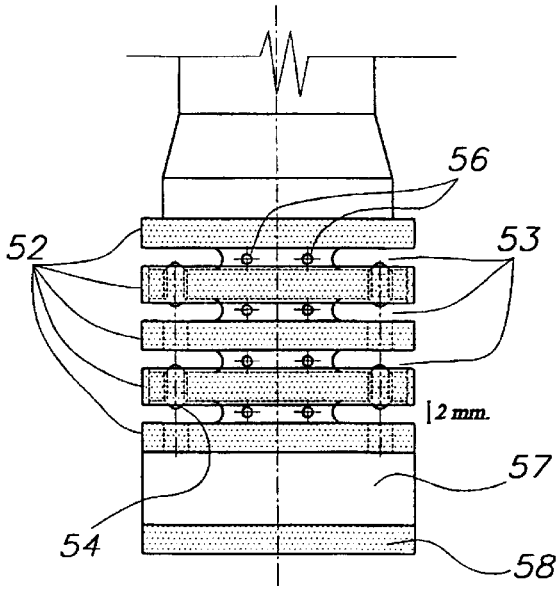
Figure 11A:
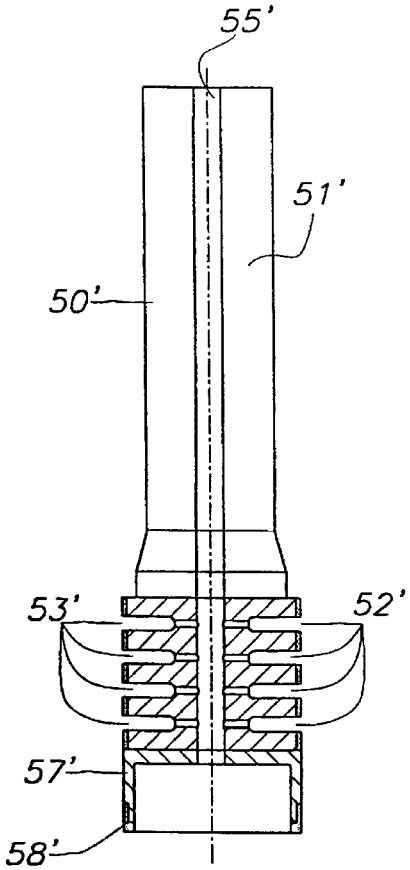
Figure 11B:
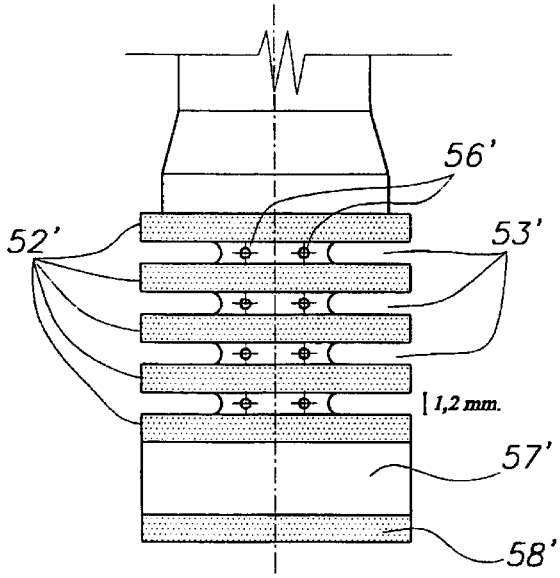

The means for putting the present invention into practical effect are illustrated hereinafter with reference to an embodiment which is preferred at the present time and which is set forth by way of non-limiting example with reference to the Figures of the accompanying drawings in which:

FIGS. 1 and 2 respectively show axonometric views with broken-away parts of first and second embodiments of the tool according to the invention, FIG. 3 is an exploded view in section of the embodiment of the tool shown in FIG. 1, FIGS. 4A, 4B, 4C and 4D show various views, being respectively an elevational view, a view in section taken on section line A—A in FIG. 4C, a view from above and a view in section taken on the line D—D in FIG. 4B, of the embodiment of the tool shown in FIG. 1, FIGS. 5A, 5B, 5C and 5D show various views of the embodiment of the tool shown in FIG. 2, being respectively an elevational view, a view in section taken on line A—A in FIG. 5C, a view from above and a view in section taken on line D—D in FIG. 5B, FIGS. 6A, 6B and 6C diagrammatically show successive progressive phases in processing of the edge of a sheet of material with a tool of the kind shown in FIG. 1 or FIG. 2, FIGS. 7A, 7B, 7C and 7D show views of the same kind as FIGS. 4A to 4D of a type of tool with a modified profile, in relation to the embodiment of FIG. 1, FIGS. 8A, 8B, 8C and 8D show views of the same kind as FIGS. 5A to 5D of a type of tool with a modified profile, in relation to the embodiment of FIG. 2, FIGS. 9A and 9B show exploded views of further embodiments of the tools shown respectively in FIG. 1 and FIG. 2, which are formed by an assembly of modular disc elements, FIGS. 10A and 10B respectively show a sectional view and a view partially in elevation of a tool for making cuts in a sheet of marble or the like using the technical teaching of the tool as shown in FIG. 1 and the Figures relating thereto, and FIGS. 11A and 11B respectively show a sectional view and a view partially in elevation of a tool for making cuts in a sheet of marble or the like using the technical teaching of the tool as shown in FIG. 2 and the Figures relating thereto.

Figure 12:
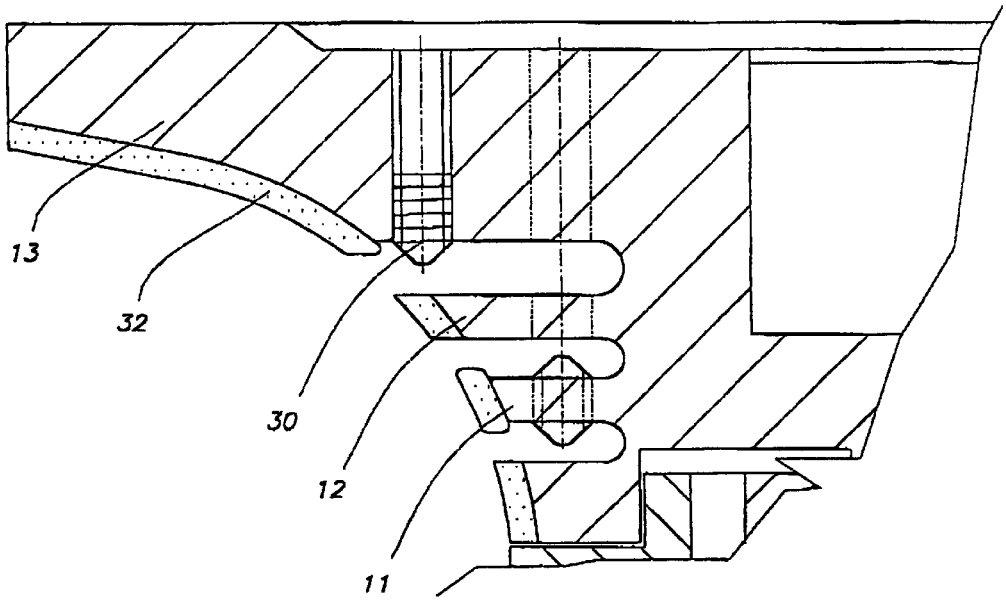

FIG. 12 shows a partial sectional view in enlarged scale of a preferred embodiment of breaker inserts or pins.

Referring to FIGS. 1, 3, 4A to 4D and 6A to 6C, the tool in accordance with a first embodiment of the invention comprises a single body 1' (FIG. 4A), or a pair of bodies 1 and 2 which are rotationally symmetrical, provided with a through hole 3 for passing a bolt 5 for mounting it to the spindle of a machine tool (not shown).

The configuration of the external part of the body 1', or the bodies 1 and 2, forms in negative relationship the configuration which is to be reproduced on the edge of a sheet or plate of marble, granite or other stone, or of glass.

The negative configuration is formed by circular parts 6 to 13 of the configuration as shown and provided with a layer of grains of diamond applied to their external surface in a manner which is known to the man skilled in the art.

It should be noted that the particular substantially semi-circular configuration of the envelope of the circular parts 6 to 13 represents a particular case which is used for convenience of representation and is not to be interpreted in any way as limiting.

At a position corresponding to the central part of the tool in question, there may possibly be provided a rolling bearing 14 which cooperates with an idly mounted ring 15 which is not driven in rotation by the spindle of the machine tool, preferably a machine tool of the manually actuated portable type, but which rolls against the contour of the sheet being processed to prevent the diamond-bearing tool from cutting excessively into the edge of the sheet to be worked.

It will be clear to a man skilled in the art that the bearing 14 and the ring 15 may be superfluous and replaced by a ring which could be provided with diamond means like the other circular parts 6 to 13, or could form a single body with the circular parts 9 and 10 to provide a continuous layer of diamond. In addition, the tool may not be subdivided into two bodies 1 and 2 but may be a monolithic machined block (FIG. 4A). An arrangement of that type could be particularly appropriate in the case of rigid machines such as those involving computer numerical control (CNC).

Looking now at the Figures in question, it will be noted that provided between the circular parts 6 to 13 are channels or grooves 20 to 25 which interrupt the semicircular envelope formed by the circular parts 6 to 13.

Projecting into the grooves 20 to 25 are inserts such as pins 30 (these can be seen in particular in FIG. 3 and FIGS. 4A to 4C) which are interposed in the spaces or grooves 20 to 25 between the circular parts 6 to 13 and which operate substantially in an impact mode, preferably angled impact, in contrast to the abrasion action of the external diamond-coated rim of the circular parts.

These inserts or pins 30 are fitted into suitable seats in the circular parts 6, 8, 11 and 13 by being screwed therein, or by being fixed or embedded therein, or by being pressed therein, or in another way, and they are made of hard tough metal, possibly provided with diamond means thereon, or of widia or the like. The number and the angular distribution of such inserts depends on the diametral dimensions of the tool to which they are fitted and on the associated circular parts.

Figure 6A:
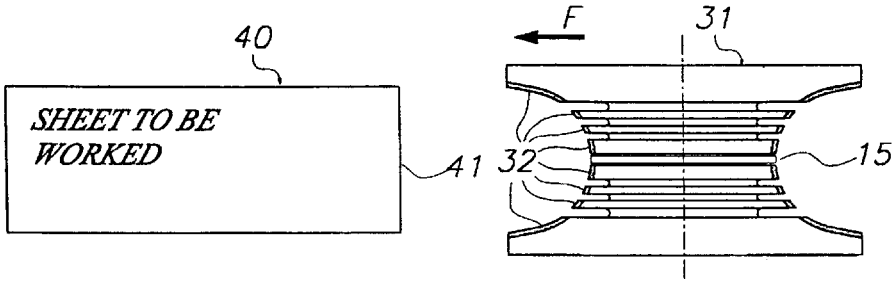
Figure 6B:
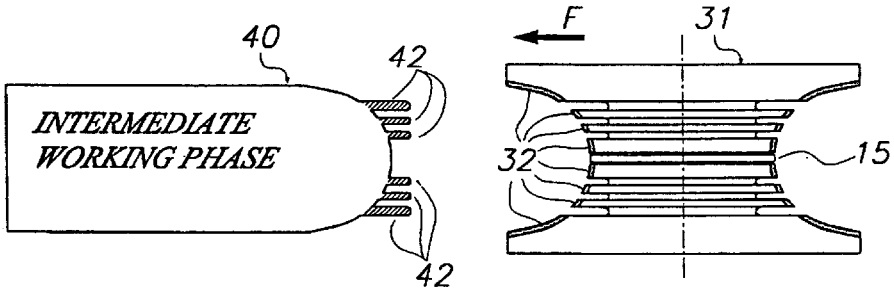
Figure 6C:
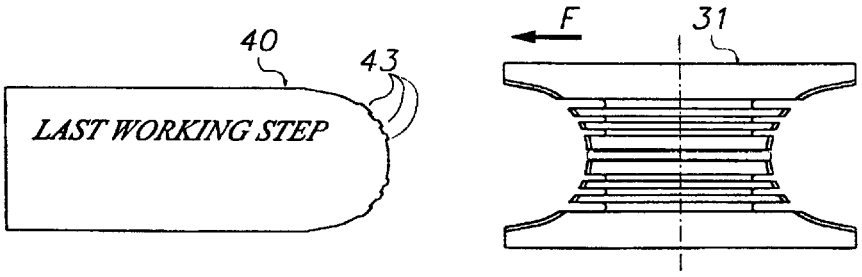
Figure 7A:
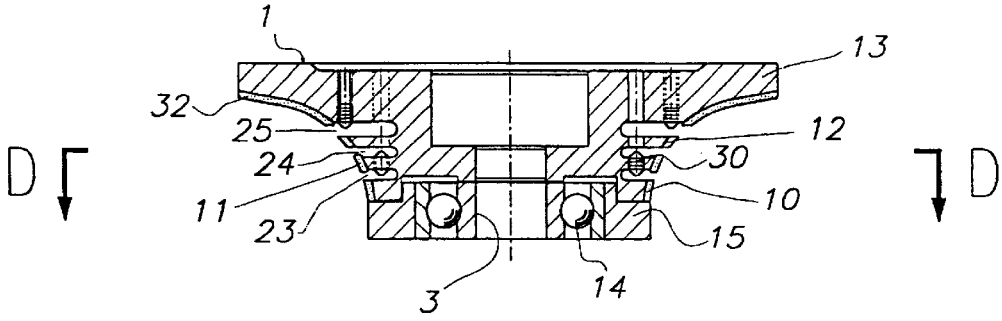
Figure 7D:
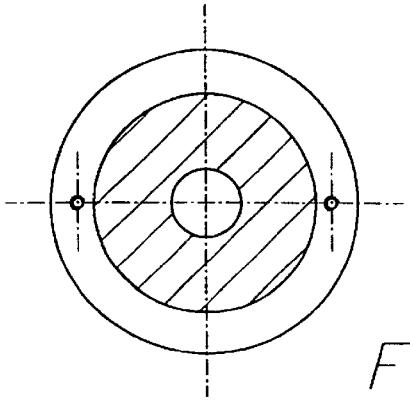
Figure 7B:
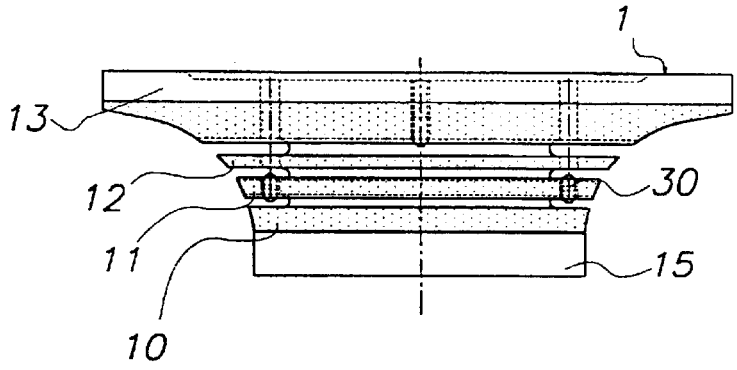
Figure 7C:
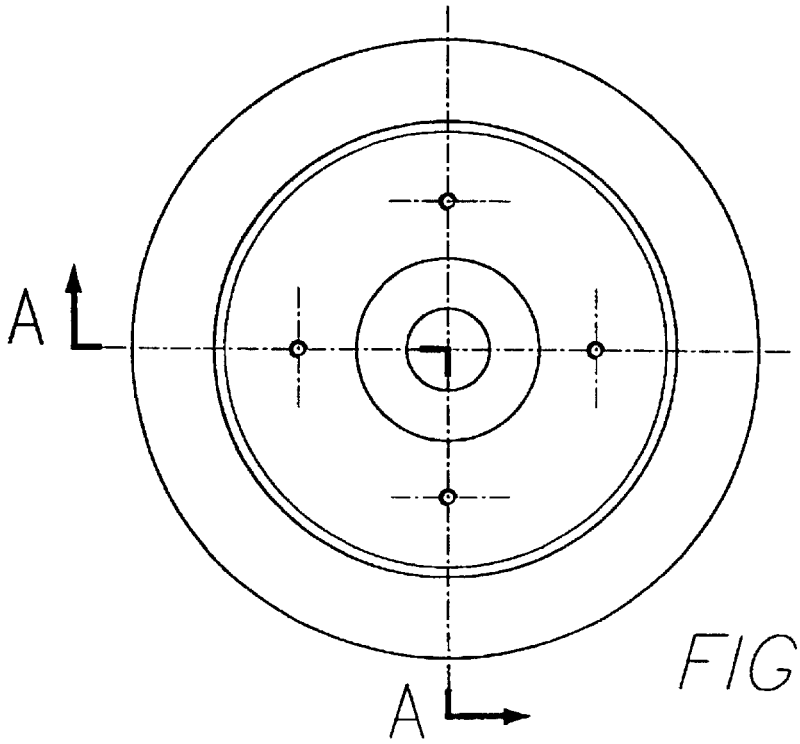
Figure 8A:
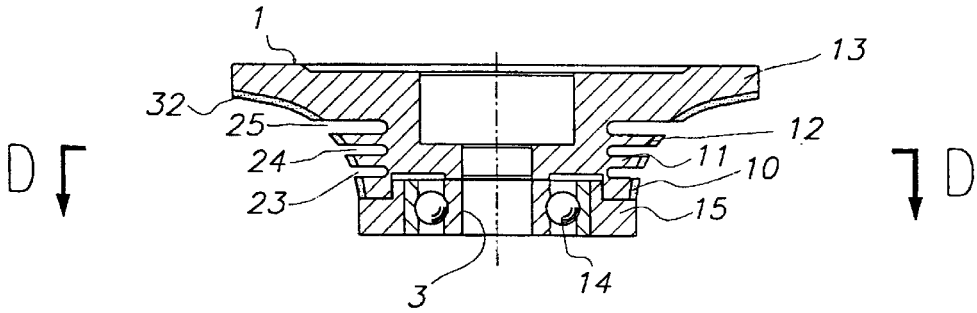
Figure 8D:
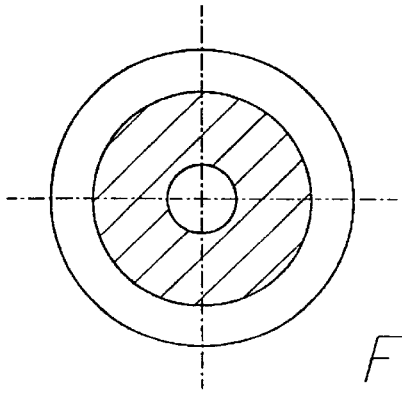
Figure 8B:
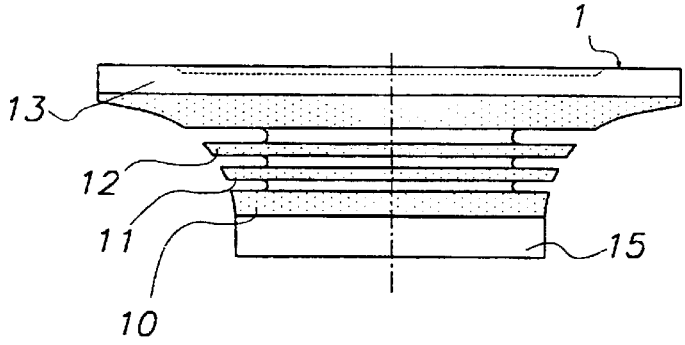
Figure 8C:
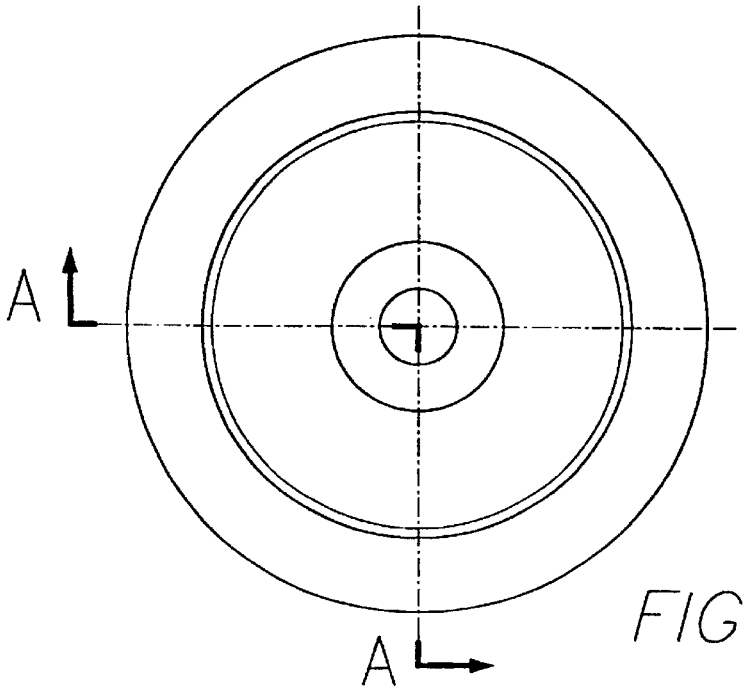

The purpose of the grooves and the inserts in question will become clearly apparent by considering FIGS. 6A to 6C. In the non-limiting example shown in those Figures, the operation of machining the stone slab 40 is intended to copy the envelope of the hollow configuration of the tool 31. The stone slab 40 initially has a squared edge 41, which is rectilinear or curved, having been prepared in preliminary machining procedures. As the tool 31 approaches in the direction of the arrow F, the diamond-bearing parts 32 (FIG. 6A) cut into the stone slab 40 by abrasion of the material. If the sheet of material 40 were of a tough material such as a metal, the result of the above-mentioned machining operation would be the formation of ribs 42 as shown in FIG. 6B, but marble, stone, granite, glass or similar are fragile materials and thus: the action of the grooves 20 to 25 and the inserts 30 would cause fragile fracture of the above-mentioned ribs 42, leaving a relatively rough surface 43 as shown in FIG. 6C, which surface can be easily finished off to the required configuration and polished using other abrasive tools of conventional type, generally diamond tools with progressively finer grains, to produce the final machined surface as desired.

It will be noted once again that the envelope of the hollow part of the tool 31 is only given by way of non-limiting indication.

It should also be noted that the presence of the inserts 30 is necessary when the grooves 20 to 25 are of a height of the order of 2 to 2.5 millimetres.

In the embodiment shown in FIG. 2 and in FIGS. 5A to 5D the grooves 20 to 25 are of a height which is no greater than about 2 millimetres. In such a case the inserts 30 are not necessary since fragile fracture of the ribs 42 will in any event occur due to the effect of the inevitable vibration of the machine tool, whether it is a portable tool or a CNC tool; also due to the fact that the diamond edges 32 of the circular parts 6 to 13 will produce micro-incisions which, with the cooperation of the lubricating-cooling water, will facilitate fragile fracture of the ribs 42.

Figure 5B:
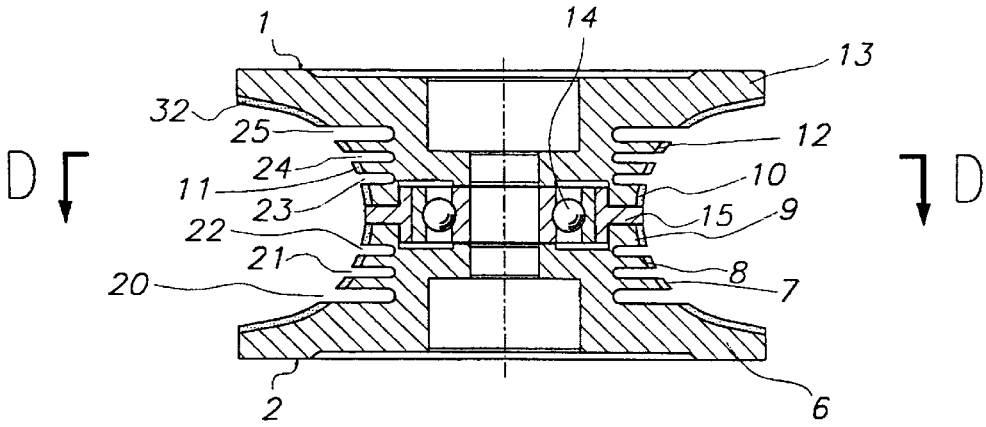
Figure 5D:
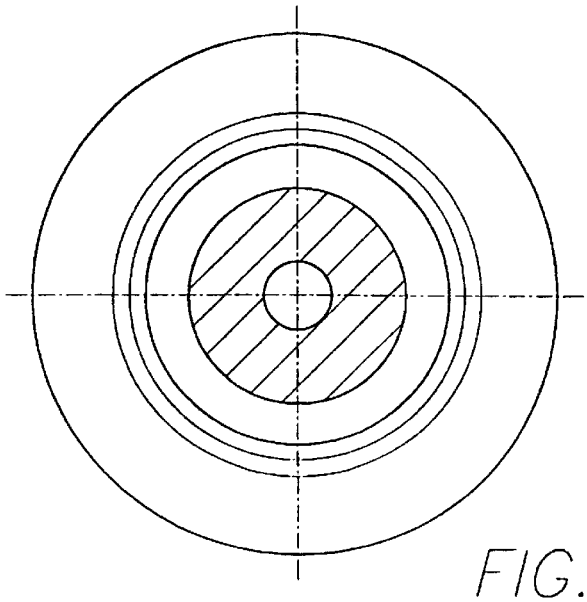

In this embodiment the tool may not be provided with the bearing 14 and the associated idler ring 15 (FIG. 5A) and in addition it may be of a configuration involving a single body 1', or two bodies 1' and 2' (FIG. 5A), or it may provide for the inclusion of the abovementioned bearing 14 and the idler ring 15 (FIG. 5B).

FIGS. 7A to 7D and FIGS. 8A to 8D show various views of a tool of the kind shown respectively in FIG. 1 and FIG. 2, but which is intended to carry out on the edge of a sheet of marble, stone or the like, a machining operation following a profile involving a pointed configuration or a quadrant of a circumference respectively; it may have wider grooves and inserts 30 or it may have narrower grooves and be without the inserts. In this embodiment also the tool may or may not be provided with the bearing 14 and the associated idle ring 15. A further detailed discussion is not thought to be necessary here.

FIGS. 9A and 9B show a series of substantially disc-shaped elements 6' to 13' which can be assembled together to form for example a tool of the kind shown in FIG. 1 and FIG. 2 respectively.

FIG. 9A shows disc elements with fitted inserts or metal pins for producing the fragile fracture effect discussed above, while FIG. 9B shows disc elements which are without such inserts. In each of those cases the disc elements are so dimensioned that, during assembly, grooves of the wider type (greater than 2 millimetres in height) for the tool with metal inserts, or narrower grooves (that is to say less than 2 millimetres in height) for the tool without inserts, are respectively formed.

The embodiments of FIGS. 9A and 9B enjoy the advantage that it is possible to replace only those diamond-coated discs which experience a greater degree of wear, such as for example those of larger diameter which, as will be readily appreciated from FIGS. 6A to 6C, have to provide for the removal of a greater amount of stony material.

The individual discs shown in FIGS. 9A and 9B are clamped together by way of any suitable means, for example a bolt such as the bolt 5 shown in FIG. 3. In addition, in the flat parts which are in mutually facing relationship, the individual discs can be provided with projections or spines (not shown) capable of preventing mutual rotational movement thereof during operation, as will be apparent to the man skilled in the art.

FIGS. 10A and 10B show a tool, intended to make milling cuts or grinding cuts in sheets of marble, granite, stone, glass or the like, which uses the concept according to the invention as identified in FIG. 1.

The construction shown in FIG. 10A is essentially that of a tang-type or candle-type milling cutter which is indicated generally by reference numeral 50, having a shank 51 for fixing to the spindle of a machine tool. Provided at the end of the shank 51 is a multiplicity of diamond-bearing rings 52 spaced by grooves 53 into which project inserts or pins of hard tough metal, or diamond-coated inserts, as indicated at 54. The grooves 53 and the inserts 54 perform the same function as the grooves 20 to 25 and the inserts 30 shown in FIG. 1 and the associated Figures. The illustrated structure also provides a passage 55 for the intake of lubricating and cooling water which issues at peripheral holes 56 disposed in the grooves 53.

The terminal end part 57 is provided with a further diamond-bearing ring 58 to provide a milling cutter of drilling cup type to be able to penetrate at any point of the surface of a sheet of marble and the like, and thus to be able to effect any type of cut, even of a closed configuration. This may be in order to start an opening of greater extent than the cross-sectional area bounded by the ring 58, for example an opening in a kitchen work top to receive a sink. The inserts or pins of hard metal 54 are, necessary when the height of the grooves 53 is greater than about 2 millimetres.

FIGS. 11A and 11B show a tool similar to that shown in FIGS. 10A and 10B but which adopts the teaching of the embodiment shown in FIG. 2, that is to say without the metal inserts but combined with a height for the grooves of less than 2 millimetres, whereby breaking of the material is due to the vibrations of the machine itself.

In FIGS. 11A and 11B, parts corresponding to those of FIGS. 10A and 10B are denoted by the same reference numerals with the addition of primes.

A preferred embodiment of the inserts or pins 30 above described is shown in FIG. 12. In this Figure, inserts or fragmenting pins 30*a* are shaped as a truncated cone, in order to obtain a better fragmenting action in the angled impact operation against the ribs 42 of the worked material.

Naturally it will be clear that those measurements which have been indicated above are to be considered as being given purely by way of non-limiting indication and may vary according to the type of material to be worked upon (grain size, hardness, fragility, microstructure etc).

The same considerations apply in regard to the shape and number of the diamond-bearing rings or discs. In addition it will be repeated that the curve which determines the final profile of the diamond-bearing surface must be interpreted merely by way of indication in terms of practical embodiment of the concept of the present invention and the means for carrying it into effect. It is thus possible to envisage numerous alternative configurations within the capability of a man skilled in the art without thereby departing from the scope of the present protection.

What is claimed is:

1. A rotary tool for producing profiles in hard fragile materials comprising; at least one rotationally symmetrical body of a configuration defined by the envelope of the circumference of a multiplicity of circular parts externally provided with diamond cutting means; said circular parts being separated one from another by grooves; the configuration corresponding in negative relationship to the profiles to be produced on said hard fragile materials and being such that production of profiles is effected jointly by abrasion on the part of the diamond cutting means and by fragile fracture breaking on the part of the grooves.

2. A tool according to claim 1 wherein the grooves are formed of a width such that, during processing, the material forms ribs sufficiently thin that mechanical vibration resulting from operation of the tool causes breaking of the ribs, such that the combined action of removal of material by the diamond cutting means and by fragile fracture of the ribs reproduces, in the sheet material, substantially the profile of the configuration of the tool.

3. A tool according to claim 1 wherein inserts are disposed in the circular parts in the proximity of the periphery thereof, said inserts projecting into the grooves to contribute to fragile fracture of material not removed by the diamond means.

4. A tool according to claim 3 wherein said inserts comprise pins of metal material.

5. A tool according to claim 3 wherein the inserts comprise truncated cones for angled impact operation against the worked material.

6. A tool according to claim 1 including a rolling bearing cooperable with a sensor element mounted idly and rotatably on the tool, the sensor element being disposed to roll against the contour of a sheet to be profiled to limit the depth of cut of the parts of the tool intended to remove the material.

7. A tool according to claim 1 wherein said symmetrically rotational body is formed of a single integral monolithic body.

8. A tool according to claim 1 wherein said rotationally symmetrical body is formed by a pair of bodies assembled to one another.

9. A tool according to claim 1 wherein said rotationally symmetrical body is formed by a plurality of separate disc elements for stacking about an axis and selective replacement.

10. A tool according to claim 1 wherein said envelope is substantially rectilinear.

11. A tool according to claim 10 including a longitudinal passage for flowing, cooling and lubricating liquid, and communication with a plurality of radial holes for discharge into the grooves.

12. A tool according to claim 11, wherein a terminal end thereof is cup shaped for producing a pilot hole in the material for starting a cutting operation.

* * * * *